United States Patent [19]

Kumasaka et al.

[11] Patent Number: 4,947,200

[45] Date of Patent: Aug. 7, 1990

[54] DEVELOPING DEVICE AND MULTI-COLOR RECORDING APPARATUS

[75] Inventors: Takao Kumasaka, Takahagi; Yuzuru Simazaki, Hitachi; Isamu Komatsu, Takahagi, all of Japan

[73] Assignees: Hitachi, Ltd.; Hitachi Koki Co., Ltd., both of Tokyo, Japan

[21] Appl. No.: 353,753

[22] Filed: May 17, 1989

[30] Foreign Application Priority Data

May 19, 1988 [JP] Japan ..... 63-120568

[51] Int. Cl.[5] ..... G03G 15/08

[52] U.S. Cl. ..... 355/251; 355/265; 355/326

[58] Field of Search ..... 355/245, 246, 251, 261, 355/265, 266, 326, 327

[56] References Cited

U.S. PATENT DOCUMENTS

| | | | |
|---|---|---|---|
| 3,702,483 | 11/1972 | Fantuzzo | 346/74 ES |
| 4,324,199 | 4/1982 | Morikawa | 355/251 X |
| 4,422,749 | 12/1983 | Hoshino et al. | 355/251 |
| 4,734,735 | 3/1988 | Haneda | 355/326 |
| 4,766,458 | 8/1988 | Oka et al. | 355/251 X |
| 4,799,086 | 1/1989 | Mori | 355/251 |
| 4,811,686 | 3/1989 | Yamane | 355/251 X |
| 4,851,884 | 7/1989 | Folkins | 355/251 X |

FOREIGN PATENT DOCUMENTS

| | | |
|---|---|---|
| 4319197 | 4/1965 | Japan . |
| 52-106743 | 7/1977 | Japan . |

*Primary Examiner*—A. C. Prescott

*Attorney, Agent, or Firm*—Antonelli, Terry, Stout & Kraus

[57] ABSTRACT

A developing device is of non-contact development type in which a toner is jumped to a photoconductor to develop a latent image on the photoconductor. The developing device is controlled in height of a developer-agent layer on a developer roll, and sets a developing gap between the photoconductor and the developer roll in such a manner that a driving electric field required for jumping of the toner can be maintained at the air gap between the photoconductor and a developer-agent layer on the developer roll and developing bias voltage can be brought to a value lower than charged electric potential of the photo-conductor. By setting the developing bias voltage to the valve lower than the charged electric potential of the photoconductor, jumping of additional or unnecessary toner is restricted so that contamination of an image and a recording sheet can be prevented. Further, a multi-color recording apparatus having this developing device prevents toner developer agents different in color from being brought into contact with each other to form a clear multi-color image without mixing in color and contamination.

20 Claims, 5 Drawing Sheets

DEVELOPING DEVICE AND MULTI-COLOR RECORDING APPARATUS

BACKGROUND OF THE INVENTION

The present invention relates to a developing device for developing an electrostatic or magnetic latent image with a toner developer agent, and to a multi-color recording apparatus using this developing device.

A multi-color recording apparatus of the kind referred to above is employed in, for example, an electrophotographic system. Generally, the recording apparatus adopts a system where a process, in which a latent image is formed on a photoconductive material by charging and exposure and subsequently a toner of colored powder is used to develop the latent image, is repeated plural times while the photoconductive material is rotated plural times.

In order to raise the speed of the multi-color recording, there is known an apparatus in which a single photoconductor is used as a latent-image carrier, and a plurality of developing devices corresponding respectively to the colors are arranged about the photoconductor to form a multi-color image during one revolution of the photoconductor. This apparatus is disclosed in, for example, in Japanese Patent Unexamined Publication No. 52-106743 and Japanese Publication No. 43-19197.

In the apparatuses disclosed in the above publications, the developer agent including a colored toner is brought into contact with the surface of the rotating photoconductor in each developing device. As a result, during the second and subsequent developments, the toner applied to the surface of the photoconductor at the first development is brought into contact with the developer agents at the second and subsequent developing devices, and is scraped off. This raises problems of a decrease in concentration or density of the print image and a mixing of the toner having a different color into the second and subsequent developing devices.

On the other hand, in order to prevent the above-mentioned scratching or scraping of the image, a method is known, in which the toner developer agent is maintained out of contact with the surface of the photoconductor, and the toner particles are jumped to the latent image during the developing process, as disclosed in, for example, U.S. Pat. No. 3,702,483. In addition, U.S. Pat. application Ser. No. 159,259 filed on Feb. 23, 1988 in the name of the inventors of this application and others discusses a reduction or a variation in the concentration or density of the image occurring in the non-contact development, and contamination of recording sheets due to adhesion of unnecessary toner particles. The inventors of this application and the others have proposed a developing device in which a magnetic-pole pitch of the developer roll is set in a specific condition to increase an area to be flown in toner, or bias voltage for forming an electric field for jumping of the toner is adjusted in accordance with a change in the developing gap, to increase and stabilize the concentration or density of the image.

SUMMARY OF THE INVENTION

It is an object of the invention to provide a developing device which is capable of further improving the aforementioned non-contact developing device by the inventors of this application and the others, to develop a latent image in a more clear manner.

It is another object of the invention to provide a developing device which is useful for being employed in a multi-color recording apparatus, without occurrence of a mixture of colors and a contamination of recording sheets, thereby obtaining stable concentration or density of an image.

It is still another object of the invention to provide a multi-color recording apparatus in which a mixture of colors and contamination of recording sheets can be dispensed with to form a multi-color image in stable concentration.

It is another object of the invention to provide a multi-color recording apparatus which is capable of obtaining a sharp or clear multi-image in an economical manner without large modification or alteration of the conventional construction.

The invention has the subject of a non-contact type developing device, and intends to decrease driving force given to the toner to the necessary minimum for the above purpose, to prevent jumping or scattering of additional toner. A multi-color recording apparatus having this developing device prevents the toner developer agents different in color from being brought into contact with each other, and forms a clear multi-color image without a mixing of colors and contamination.

According to one aspect of the invention, there is provided a developing device for a latent image formed on a charged carrier, comprising roll means for forming a driving electric field at a gap between the latent-image carrier and a toner developer-agent layer, to jump a toner to the latent image on the carrier to develop the latent image; and means for setting a developing gap between the carrier and the roller means in such a manner that a developing bias voltage for the driving electric field is brought to a value lower than a charged electric potential of the carrier and the driving electric field required for jumping of the toner is maintained.

According to another aspect of the invention, there is provided a multi-color recording apparatus in which a plurality of latent images corresponding to different colors are formed on a charged carrier, and these latent images are developed successively by a plurality of colored toner developer agents, the multi-color recording apparatus comprising a first developer unit for bringing a first one of the plurality of colored toner developer agents contact into the latent images on the carrier to develop a corresponding one of the latent images; and at least one subsequent developer unit for carrying a different toner developer agent with a gap from the latent-image carrier to jump a toner of the different developer agent to the latent image through a driving electric field formed at the gap thereby developing the latent image, the subsequent developer unit having means for controlling a height of the different toner developer agent in at least a developing area, the subsequent developer unit being arranged with a developing gap lower than that of the first developer unit from the latent-image carrier.

BRIEF DESCRIPTION OF THE DRAWINGS

The above objects and advantages as well as other objects, advantages and features of the invention will become clear from the ensuing description and the appended claims with reference to the drawings.

In the drawings.

DETAILED DESCRIPTION OF THE PREFERRED EMBODIMENTS

Figure 1:
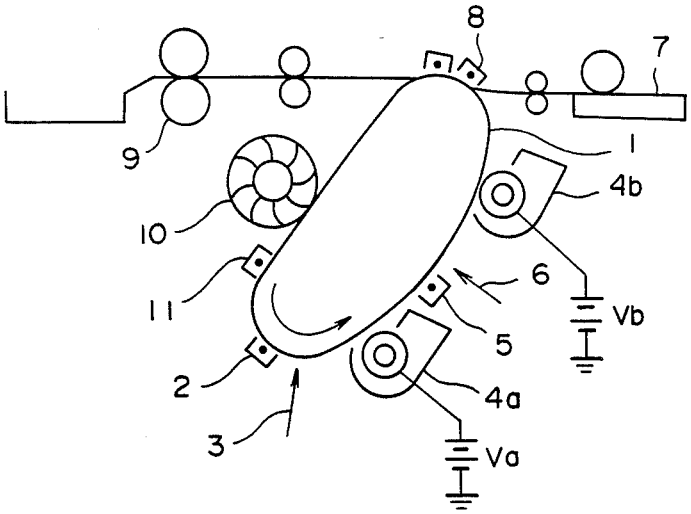
FIG. 1 is a diagrammatic view showing the construction of a multi-color recording apparatus according to an embodiment of the invention.

A basic or fundamental idea of the invention will first be described.

In a non-contact development, causes of contamination of an image and a recording medium or sheet due to jumping of unnecessary toner particles are mainly as follows and so on:

(1) an electric force acting upon the toner resulting from excessive developing bias;
(2) accentrifugal force acting upon the toner due to rotation of a developer roll; and
(3) promotion of influence of the centrifugal force due to standing-up of the toner in an ear or chain manner on the developer roll.

The inventors of this application take the aforesaid constitution in view of the above causes. That is, in the non-contact type developing device, the developing bias voltage is brought to a value lower than the charged electrical potential of the photoconductor, while maintaining the driving electric field for jumping of the toner at the gap of the developing area. Accordingly, in order to obtain a predetermined image concentration or density, there is no developing bias applied with the surface electrical potential of the photoconductor exceeded considerably, so that the mixing in colors of the image and the contamination can be restrained to their respective values lower than permissible values. In addition, because of the decrease in the developing bias, if the height of the developer-agent layer is reduced to decrease the developing gap, the more the influence of the promotion of the centrifugal force is reduced, the more the height of the developer-agent layer is lowered, to enable prevention of the mixing in colors and the contamination of the image.

Hereunder, the invention will be described with reference to embodiments illustrated in the drawings.

FIG. 1 shows a multi-color recording apparatus according to an embodiment of the invention. The apparatus has its construction which is employed in a two-color electrophotographic process. Referring to FIG. 1, a photoconductor 1 in the form of an endless belt is mounted rotatably. Arranged about the photoconductor 1 along a rotational direction thereof are instruments for producing first- and second-color toner images. The multi-color recording apparatus is further provided with a recording-sheet supply cassette 7, a transfer unit 8, a fixing unit 9, a cleaner 10 and a de-charger 11.

The instruments for the first-color image include a first charger 2, a first exposure system 3 and a first-color developer unit 4*a*. The instruments for the second-color include a second charger 5, a second exposure system 6 and a second developer unit 4*b*. The photoconductor 1 is illuminated with lights corresponding respectively to desired images from the first and second exposure systems 3 and 6. Bias voltages $V_a$ and $V_b$ are applied respectively to the first- and second-color developer units 4*a* and 4*b* , for transferring the toners of developer agents from developing sleeves thereof to the photoconductor 1. In the illustrated embodiment, the first-color developer unit 4*a* is of contact type in which the toner developer agent is brought into contact with the latent image on the photoconductor 1 to effect development, while the second-color developer unit 4*b* takes a non-contact developing system in order not to scrape the first-color toner image.

In the operation of the multi-color recording apparatus constructed as above, the photoconductor 1 is charged uniformly by the first charger 2 when the photoconductor 1 rotates about its axis, and the photoconductor 1 is then illuminated with the light from the first exposure system 3. The charge on the exposed portion of the photoconductor 1 is removed so that a latent image having a desirable image is formed on the photoconductor 1 in a manner known well. The latent image on the photoconductor 1 is developed by the first-color developing unit 4*a* and is brought to an image due to the first toner. Subsequently, in a similar manner, an image due to the second toner is formed on the photoconductor 1 by the second charger 5, the second exposure system 6 and the second developer unit 4*b*. These latent images are transferred at the transfer unit 8 onto a cut sheet supplied from the recording-sheet supply cassette 7. Subsequently, the cut sheet is sent to the fixing unit 9 where the toners are fused and fixed to the cut sheet to form a permanent image. In this connection, the cut sheets are used here, but a continuous web can also be employed in a similar manner.

Subsequently, the residual toners on the photoconductor 1 are removed by the cleaner 10. The surface electric potential on the photoconductor 1 is set to a predetermined initial value, and the photoconductor 1 is again sent to the first charger 2. The above operations are repeated. The component parts and the operation of the embodiment constructed as above should be the same as the conventional apparatus except for the developer units, and further description will be omitted here.

Figure 2:
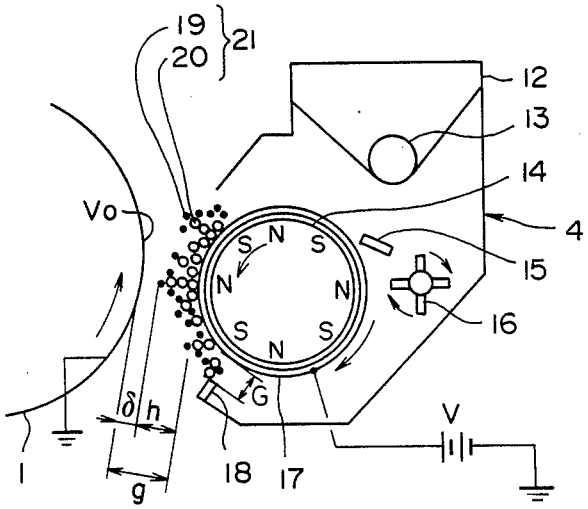
FIG. 2 is an enlarged view of a principal portion of FIG. 1.

Referring next to FIG. 2, the construction of the developer units will be described. The first- and second-color developing units 4*a* and 4*b* are basically the same in construction as each other, and are treated here as a developer unit 4 on behalf of them. Used in this developer unit 4 is a binary developer agent which is a mixture of a colored toner 19 and a magnetic carrier 20. The developer unit 4 comprises a magnet roll 14 and a developer sleeve 17 arranged about an outer periphery of the roll in concentric relation thereto. The magnet roll 14 and the developer sleeve 17 are connected to a drive unit (not shown) and are rotatable in directions opposite to each other as indicated by arrows in FIG. 2.

The magnet roll 14 is provided on its outer periphery with a plurality of magnets in order to hold the developer agent. The magnet roll 14 cooperates with the developer sleeve 17 to form a carrier for the developer agent. This developer-agent carrier is arranged within the developer unit 4 and extends along an opening provided in the developer unit so as to be opposed to the photoconductor 1. In addition, arranged within the developer unit 4 are a toner supply roller 13, steering blades 16, a scraper 15 for scraping the developer agent from the developer sleeve 17, and a regulate plate 18 for regulating the height of the developer agent.

With this arrangement, the toner 19 within the toner hopper 12 is fed downwardly through the roller 13, is mixed with the magnetic carrier 20 by the steering blades 16, and reaches a location below the developer sleeve 17. When the magnet roll 14 and the developer sleeve 17 rotate in their respective directions indicated by the arrows in the figure, the developer agent is held on the developer sleeve 17, in the form of a brush consisting of a plurality of ears or chains. The developer agent is moved from below to above in FIG. 2, while the height of the developer agent is regulated by the regulator plate 18. The developer agent having passed over the developing position is scraped by the scraper 15.

In FIG. 2, g represents a developing gap between the photoconductor 1 and the developer sleeve 17, h represents a thickness of the developer-agent layer on the developer sleeve 17 at the developing position, and $\delta$ represents a gap between the developer agent and the photoconductor 1 at the developing position. Further, G is a gap between the regulator plate 18 and the developer sleeve 17. In case of development of the contact system, $\delta<0$ and developing bias is not necessarily required. In case of development of the non-contact system, however, $\delta>0$. Because of no contact between the photoconductor 1 and the toner developer agent, developing bias is necessary and the bias voltage V equal to or slightly lower than the surface electric potential $V_0$ of the photoconductor 1 is applied to the developer sleeve 17, so that only the toner 19 is transferred to the photoconductor 1 to effect the development.

Figure 3:
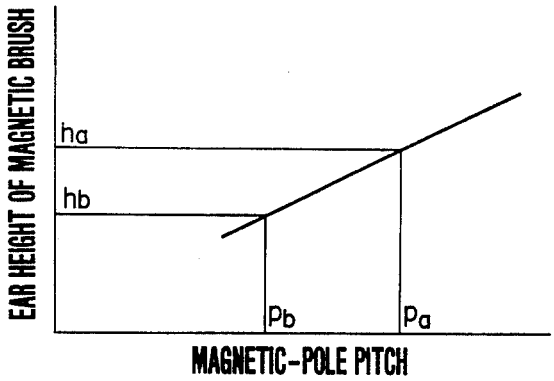
FIG. 3 is a graph for explanation of the relationship between a thickness of a developer-agent layer and a magnetic-pole pitch of a magnetic roll, used in the multi-color recording apparatus illustrated in FIG. 1.
Figure 4A:
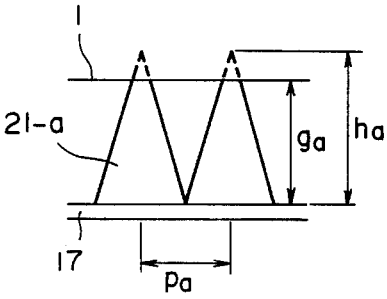
FIG. 4*a* is a diagrammatic view showing the thickness of the developer-agent layer in a first developer portion of the multi-color recording apparatus illustrated in FIG. 1.
Figure 4B:
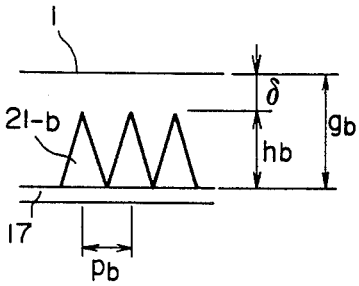
FIG. 4*b* a diagrammatic view showing the thickness of the developer-agent layer in a second developer portion of the multi-color recording apparatus illustrated in FIG. 1.

The inventors of this application have found that the thickness of the developer-agent layer on the developer sleeve 17 varies when the magnetic pitch P of the magnet roll 14 varies, while the conditions are maintained constant such as the regulator plate gap G, rotation of the developer-agent carrier and the like. This is, as shown in FIG. 3, the smaller the magnetic pitch P, the smaller the thickness of the developer agent. For instance, when the magnetic-pole pitch is reduced from $P_a$ to $P_b$, the thickness of the developer-agent layer is reduced from $h_a$ to $h_b$. Hereunder, the thickness of the developer-agent layer will be referred to as "an ear height in the magnetic brush" in this specification.

In the embodiment described above, the magnet roll 14 of the second-color developer unit **4*b* is constructed on the basis of the above law or rule in such a manner that the magnetic-pole pitch $P_b$ is brought to a value lower than the magnetic-pole pitch $P_a$ of the magnet roll of the first-color developer unit 4*a*. Further, as described previously, the first-color developer unit 4*a* is the contact development system, while the second-color developer unit 4*b* is the non-contact development system. The gap 6 between the photoconductor 1 and the developer-agent layer is set to substantially zero or positive. Here, the gap 6 of substantially zero does mean a diameter of one of the toner particles, for example, about 10 $\mu$m and, desirably, the gap is of the order of 100 $\mu$m. However, it is practically difficult to accurately control the ear height of the magnetic brush of the order of $\mu$m. Even if the gap $\delta$ is set to 10 $\mu$m on the average, the partial toner will be brought into contact with the photoconductor 1**. On the other hand, when consideration will be made to the mixing in colors due to adhesion of the toner to the photoconductor and the contamination of the recording medium or sheet, the mixing in color becomes remarkable if a black toner is equal to or above a value of the order of 5% through 7% in the weight ratio or the area ratio, in the most remarkable case of mixing of the black toner into another colored image except for the black. Accordingly, in this specification, the case where the mixing of the toners is brought to the above ratio will be included in the non-contact development.

With the above arrangement, as shown in FIG. **4*a* and 4*b*, the thickness $h_b$ of a developer-agent layer $\mathbf{21}_b$ of the second-color developer unit is brought to a value smaller than the thickness $h_a$ of a developer-agent layer $\mathbf{21}_a$ of the first-color developer unit. As a result, it is possible that the developing gap $g_b$ of the second developer unit is equal to or lower than the developing gap $g_a$ of the first-color developer unit, while the second-color developer unit 4*b* is brought to the non-contact developing system, that is, the gap $\delta$ is secured. If the developing gap $g_b$ is narrow, it is possible to secure the toner jumping electric field in the second developer unit to maintain the predetermined image concentration or density, and to effectively prevent jumping of unnecessary toner, even if the bias voltage $V_b$ is set to a value lower than the surface electrical potential $V_0$ of the photoconductor 1**.

The above embodiment is directed to the multi-color recording having two colors. However, it is needless to say that a multi-color recording having three or more colors can be altered. In this case, the magnetic-pole pitch of the magnet roll of each of the second-color and subsequent developer units is made smaller than that of the first-color developer unit, and each of the second-color and subsequent developer units is brought to the non-contact development, whereby it is possible to obtain advantages similar to those of the above embodiment.

Further, as the method of reducing the ear height of the magnetic brush, the above embodiment takes the construction in which (i) the magnetic-pole pitch of the magnet roll is reduced. In addition thereto, there are (ii) a method of bringing the saturation magnetization of the magnetic powder of each of the second and subsequent developer agents, to a value lower than the saturation magnetization of the magnetic powder of the first-color developer agent, and (iii) a method of bringing the regulator plate gap G of each of the second-color and subsequent developing units, to a value lower than the regulator plate gap of the first-color developer unit. These methods can be employed singly and in combination.

Moreover, in substitution for the binary developer agent of the above embodiment, it is possible to use a single-component developer agent consisting of a magnetic toner in which magnetic powder is included in the toner. In this connection, the magnet roll is arranged rotatable in the embodiment illustrated in FIG. 2. However, the magnet roll may be fixed.

Figure 5:
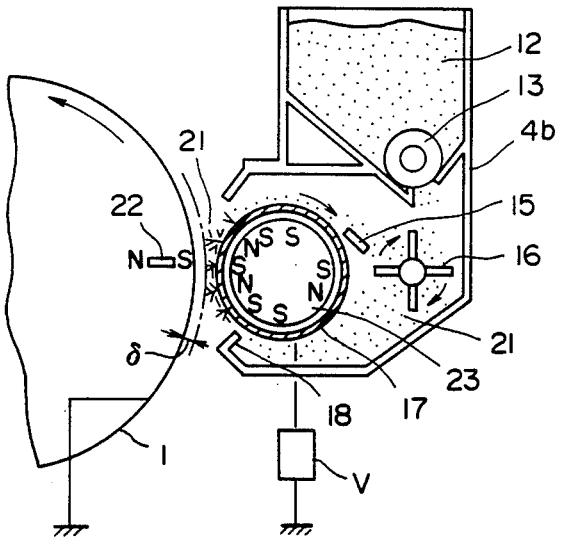
FIG. 5 is a diagrammatic cross-sectional view of a developing device according to another embodiment of the invention.
Figure 6:
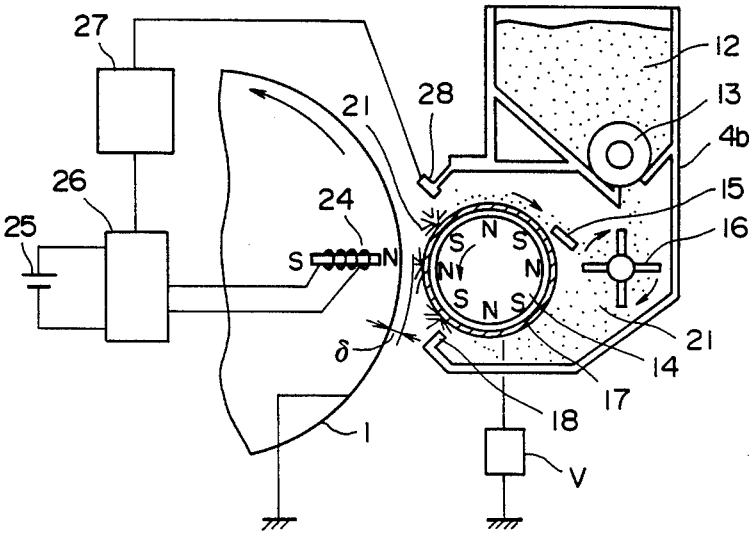
FIG. 6 is a diagrammatic cross-sectional view of a developing device according to still another embodiment of the invention.

Developing devices according respectively to another embodiments of the invention are shown in FIGS. 5 and 6. The developing devices illustrated in these figures are different from the embodiment illustrated in FIG. 2 in that a magnet unit is provided in opposed relation to the developer unit 4*b* with the photoconductor 1 positioned between them. Another component parts of each of the additional embodiments should be the same as those of the previously described embodiment, and are designated by the same reference numerals in FIG. 2. The description of these same component parts will therefore be omitted.

In FIGS. 5 and 6, the magnet units 22 and 24 are provided respectively for controlling the ear heights of the magnet brushes on the magnet rolls, and are arranged respectively such that portions of the units opposed to the magnet rolls have the same polarities as the magnet poles of the magnet rolls 23 and 14 which are located closest to the photoconductors 1. In case of the embodiment illustrated in FIG. 5, the magnet roll 23 is fixed and, therefore, the magnet unit 22 is a permanent magnet. In case of the embodiment illustrated in FIG. 6, however, the magnet roll 14 rotates and, therefore, the magnet unit 24 has an electromagnet connected to a power source 25, and a switch 26 for switching the polarity of the power source 25. Further, a magnet sensor 28 is provided adjacent the magnet roll 14, so that the switch 26 is operated on the basis of a detecting signal through a controller 27. Thus, the electromagnet of the magnet unit 24 is switched in electric polarity in synchronism with the developing electric polarity of the magnet roll of the developer unit 4*b*.

According to the developing devices illustrated in FIGS. 5 and 6, there are obtained advantages similar to those of the developer units of the previous embodiments and, in addition thereto, it is possible to prevent, thanks to the magnetic units 22 and 24 arranged within the photoconductors 1, the developer agent carriers from adhering to the photoconductors 1.

Figure 7:
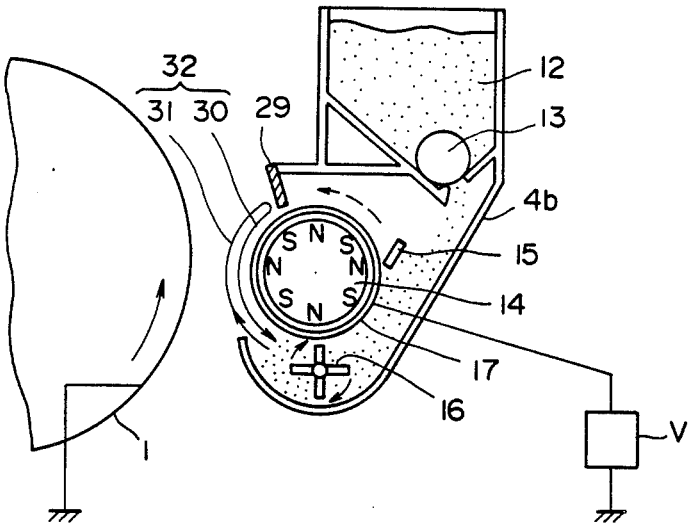
FIG. 7 is a diagrammatic cross-sectional view of a developing device according to still further embodiment of the invention.

FIG. 7 shows a developing device according to still another embodiment of the invention. This developing device is so arranged that the magnet roll 14 and the developer sleeve 17 rotate together in a direction indicated by the broken line in the figure, and the steering blades 16 are located below the developer sleeve 17. Further, a stopper 29 is provided above the developer sleeve 17 so as to interrupt flow of the developer agent. In this embodiment, when the magnet roll 14 and the developer sleeve 17 rotate, in the developing area, the magnetic force of the magnet roll 14 creates an upper layer portion 31 of the developer agent which moves upwardly from the below in the figure. This upper layer portion 31 is interrupted by the stopper 29, and friction to the developer sleeve 17 creates a lower layer portion 30 of the developer agent, which flows out downwardly in the figure.

Figure 8:
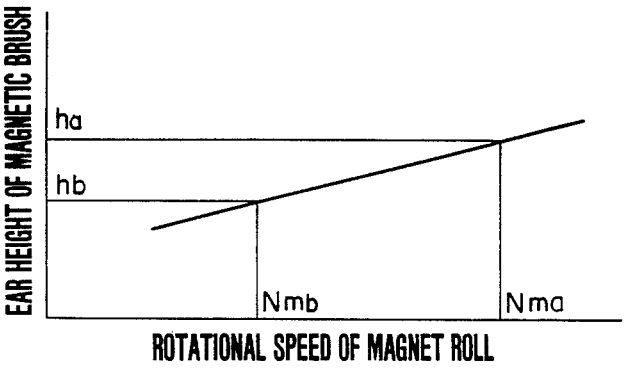
FIG. 8 is a graph for explanation of the relationship between a thickness of a developer-agent layer and a rotational speed of a magnet roll in the developing device illustrated in FIG. 7.

As shown in FIG. 8, when, for instance, the rotational speed of the developing sleeve is kept constant, the thickness of the developer-agent layer 32 is controlled by changing the rotational speed of the magnet roll 14. Accordingly, in case where the developer device according to this embodiment is used in, for example, the multi-color recording apparatus illustrated in FIG. 1, the rotational speed $N_b$ of the magnet roll 14 of the second-color developer unit 4*b* should be set to a value lower than the rotational speed $N_a$ of the first-color developer unit 4*a*. Alternatively, although FIG. 8 shows the result in the case where the rotational speed of the developing sleeve 17 is kept constant, the thickness of the developer-agent layer 32 can be decreased also by increasing the rotational speed of the developing sleeve in the arrangement shown in FIG. 7 if the rotational speed of the magnet roll 14 is kept constant. In this case, therefore, the rotational speed $N_{sb}$ of the developing sleeve of the second-color developer unit 4*b* should be set to a value larger than the rotational speed $N_{sa}$ of the developing sleeve of the first-color developer unit 4*a*.

Also in this embodiment, as the height of the developer agent can be controlled by the control of the rotational speed, it is possible to bring the developer unit to a non-contact system having a gap at the developing position, and to set the developing gap to a value equal to or lower than that of the developer unit of the contact developing system. Accordingly, like the previous embodiment, it is possible to prevent a mixing of colors due to jumping or scattering of the toner and the contamination of the recording sheet, and to obtain a predetermined image concentration or density.

In connection with the above, in the developer units according to the embodiments described above, it is possible to compensate the amount of supply of the toner by adjustment of the particle size or diameter of the carrier of the developer agent, if reduction of the ear height of the magnetic brush causes the amount of supply of the toner to be reduced excessively. That is, if the particle size $D_{cb}$ of the carrier is made smaller than the carrier particle size D of the developer unit of the contact development system, the predetermined or necessary quantity of electric charge of the toner can be ensured even when a content of the toner is increased correspondingly to an increase in the carrier surface area per unit volume. In this manner, it is possible to raise the toner concentration, that is, the weight ratio of the toner with respect to the developer agent, to compensate the amount of supply of the toner.

Further, in the non-contact development, if the development reproducibility (resolution) of a fineline latent image is lowered, the particle size $D_{tb}$ of the toner is made smaller than the toner particle size $D_{ta}$ of the developer unit of the contact developing system, making it possible to secure the resolution of the order the same as that of the developer unit of the contact development system.

Figure 9:
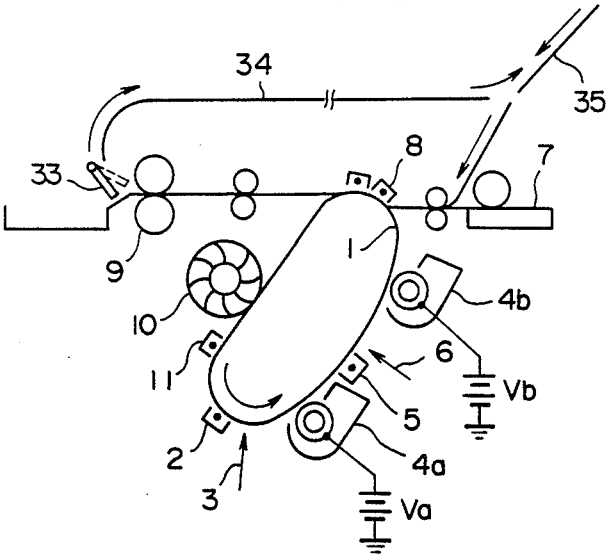
FIGS. 9 and 10 are diagrammatic views respectively showing multi-color recording apparatuses according to another embodiments of the invention.

FIG. 9 shows a multi-color recording apparatus according to still another embodiment of the invention. The embodiment is different from the embodiment illustrated in FIG. 1 in that a separating pawl 33 is provided on the outlet side of the fixing unit 9, and a reverse path 34 and an intermediate tray 35 are provided in connection with the separating pawl 33. This separating pawl 33 feeds or sends the cut sheets from the fixing unit 9 to the reverse path 34, in response to a predetermined command signal. Further, the intermediate tray 35 moves the cut sheets rearwardly to reverse the front and back sides of the cut sheets. With such arrangement, the two-color recording is made possible to the both sides of the cut sheets.

Like the embodiment illustrated in FIG. 1, in the present embodiment, the first- and second-color developer units 4*a* and 4*b* are arranged such that the inflow direction of the developer agent to the developing area is the same as the moving direction of the photoconductor 1. With such arrangement, the difference in speed between the latent image and the toner jumping the gap at the non-contact developing position is reduced, making it possible to enhance the follow-up ability of the toner to the latent image.

Figure 10:
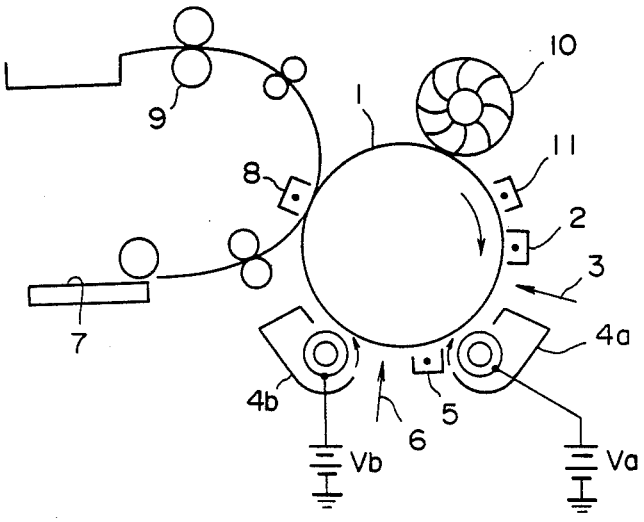

A multi-color recording apparatus according to still another embodiment of the invention is shown in FIG. 10. The first- and second-color developer units 4*a* and 4*b* are arranged below the photoconductor 1 in symmetric relation to each other. As a result, in the first-color developer unit 4*a* , inflow of the developer agent into the developing area is opposed to the moving direction of the photoconductor 1, but there is no fear that the mixing in colors occurs due to falling of the developer agent from the upper developer unit into the lower developer unit, and due to falling of the floating developer agent.

In connection with the above, in any of the embodiments described here, means is provided for reducing the ear height of the magnetic brush of the developer agent to set the developing gap so as to maintain the driving electric field for jumping of the toner in the developing device and so as to bring the developer bias voltage to a value lower than the charged electric potential of the photoconductor. However, the arrangement may be such that, in addition to means for reducing the ear height of the magnetic brush, the method of reducing electric resistance of the magnetic brush or the developer-agent layer is used, whereby the developing bias voltage is reduced while the electric field of the development gap is maintained.

The multi-color recording apparatus according to the invention can be used as a terminal instrument of a computer system, or a recording apparatus for facsimile or a word processor, in addition to the electrophotographic system described with reference to the embodiments.

The embodiments have been described above. It is to be understood, however, that the invention should not be limited to these specific forms, but various modifications and changes can be made to the invention within the scope of the appended claims, and another forms may be taken to the invention.

What is claimed is:

1. A developing device for a latent image formed on a charged carrier, comprising:

roll means for forming a driving electric field between the latent-image carrier and a toner developer-agent layer, to jump a toner of the developer agent to the latent image on the carrier thereby developing the latent image; and means for setting a developing gap between the carrier and the roll means in such a manner that a developing bias for the driving electric field is brought to a value lower than a charged electrical potential of the carrier, and the driving electric field is maintained which is required for jumping of the toner.

2. A developing device according to claim 1, wherein said means for setting said developing gap includes means for controlling a height of the developer-agent layer carried by said roll means such that the developing gap is reduced.

3. A developing device according to claim 2, wherein said roll means has a magnet roll provided at its periphery with a plurality of magnets, for carrying the developer agent, and wherein said means for controlling the height of said developer-agent layer includes a magnet unit arranged in opposed relation to one of the magnets of said magnet roll at a developing position with said latent-image carrier positioned therebetween, said magnet unit being the same in polarity as one of the magnets of said magnet roll located at said developing position.

4. A developing device according to claim 3, wherein said magnet roll is arranged rotatable, and wherein said magnet unit is variable in polarity depending upon one of the magnets of said magnet roll located at said developing position.

5. A developing device according to claim 2, wherein said roll means includes a rotary roll provided in its periphery with a plurality of magnets, for carrying the developer agent, and wherein said means for controlling the height of said developer-agent layer includes a stopper for interrupting flow of the developer-agent layer carried by aid rotary roll, and means for controlling rotation of said rotary roll.

6. A developing device for a latent image formed on a charged carrier, comprising:

developer roll means for carrying a toner developer agent with a gap from the latent-image carrier and for forming a driving electric field at the gap by means of a developing bias voltage to jump a toner of the developer to the latent image; and means for adjusting height of a toner developer-agent layer carried by said developing roll means, whereby a developing gap between the latent-image carrier and the developing roll means can be reduced so that the driving electric field for jumping of the toner is maintained by a developing bias voltage lower than a charged electric potential of the latent-image carrier.

7. A developing device in which a gap is interposed between a latent-image carrier and a toner developer agent to effect development, said developing device comprising means for adjusting a height of a toner developer-agent layer at a developing position.

8. A multi-color recording apparatus in which a plurality latent images corresponding to different colors are formed on a charged carrier, and these latent images are successively developed by a plurality of colored toner developer agents, said multi-color recording apparatus comprising:

first developer unit for bringing a first-color one the toner developer agents into contact with the latent images on the carrier to develop a corresponding one of the latent images; and at least one subsequent developer unit for carrying anther one of the toner developer agents with a gap from he latent-image carrier, to jump a toner of the other developer agent to the latent image though a driving electric field formed at said gap thereby developing he latent image, wherein said subsequent developer unit comprises mans for controlling a height of the other toner developer agent in at least a developing area, said subsequent developer unit being arranged with a developing gap smaller than that at said first developer unit from latent-image carrier.

9. A multi-color recording apparatus according to claim 8, wherein each of said first and subsequent developing units includes a developer roll provided at its periphery with a plurality of magnets, for carrying the toner developer agent, and wherein said means for controlling the height of the toner developer agent of said subsequent developer unit includes the magnets of the developer roll of the subsequent developing unit arranged at a magnetic-pole pitch smaller than the magnets of the developing roll of the first developer unit.

10. A multi-color recording apparatus according to claim 8, said means for controlling the height of the toner developer agent of said subsequent developer unit is magnetic powder of the developer agent smaller in saturation magnetization than magnetic powder of the developer agent of the first developer unit.

11. A multi-color recording apparatus according to claim 8, wherein said subsequent developer unit has a magnet roll provided at its periphery with a plurality of magnetx for carrying the developer agent, and wherein said means for controlling the height of said toner developer agent includes a magnet unit arranged in opposed relation to one of the magnets of said magnet roll located at a developing position with the latent-image carrier positioned therebetween, said magnet unit being the same polarity as one of the magnets of said magnet roll located at the developing position.

12. A multi-color recording apparatus according to claim 11, wherein said magnet roll is arranged rotatably, and wherein said magnet unit is variable in polarity depending upon one of the magnets of the magnet roll located at the developing position.

13. A multi-color recording apparatus according to claim 8, wherein said subsequent developer unit includes a rotary roll provided at its periphery with a plurality of magnets for carrying the developer agent, and wherein said means for controlling the height of the toner developer agent includes a stopper for interrupting flow of a developer-agent layer carried by said rotary roll, and means for controlling rotation of said rotary roll.

14. A multi-color recording apparatus according to claim 8, wherein said carrier of the developer agent used in said subsequent developer unit is so set that a mean particle size is smaller than that of the carrier of the developer agent used in said first developer unit, and the developer unit in the subsequent developer unit is higher in toner concentration than the developer agent of the first developer unit.

15. A multi-color recording apparatus according to claim 8, wherein said toner of the developer agent used in said subsequent developer unit is smaller in mean particle size than the toner of the developer agent used in said first developer unit.

16. A multi-color recording apparatus according to claim 8, wherein said latent-image carrier is provided movably so as to come around said first and subsequent developer units, and wherein said subsequent developer unit is so arranged that an inflow direction of the developer agent to the developing area is the same as a moving direction of said latent-image carrier.

17. A multi-color recording apparatus according to claim 8, wherein the multi-color recording apparatus is used as a terminal instrument of a computer system.

18. A multi-color recording apparatus according to claim 8, wherein the multi-color recording apparatus is used as a printer for a facsimile.

19. A multi-color recording apparatus according to claim 8, wherein the multi-color recording apparatus is used as a printer for a word processor.

20. A multi-color recording apparatus in which a plurality of latent images are formed on a charged movable carrier, and these latent images are successively developed by a plurality of colored toner developer agents, said multi-color recoding apparatus comprising:

a first developer unit for bringing a first-color one of the toner developer agents into contact with the latent images on the carrier to develop a corresponding one of the latent images; and at least one subsequent developer unit arranged downstream of said first developer unit with respect to a moving direction of the latent-image carrier, for carrying another one of the toner developer agents with a gap from the latent-image carrier, to jump a toner of the other developer agent to the latent image through a driving electric field formed at said gap thereby developing the latent image, and means for setting a developing gap between said carrier and said roller means in such a manner that a developing bias voltage for the driving electric field is brought to a value lower than a charged electric potential of the carrier and the driving electric field required for jumping of the toner is maintained.

* * * * *